US005951407A

United States Patent [19]

Teitloff

[11] Patent Number: 5,951,407

[45] Date of Patent: Sep. 14, 1999

[54] BOWLING BALL WITH ASYMMETRICAL CORE

[75] Inventor: Randell R. Teitloff, Paducah, Ky.

[73] Assignee: Ebonite International, Inc., Hopkinsville, Ky.

[21] Appl. No.: 08/414,224

[22] Filed: Mar. 31, 1995

[51] Int. Cl.[6] ..... A63B 37/06

[52] U.S. Cl. ..... 473/126; 273/DIG. 20

[58] Field of Search ..... 473/126; 273/DIG. 20

[56] References Cited

U.S. PATENT DOCUMENTS

| | | | |
|---|---|---|---|
| Re. 34,614 | 5/1994 | Gentiluomo | 473/126 |
| 4,131,277 | 12/1978 | Randolph | 473/126 |
| 4,183,527 | 1/1980 | Amburgey | 473/126 |
| 4,592,551 | 6/1986 | Lee | 473/126 |
| 4,802,671 | 2/1989 | Gentiluomo | 473/126 |
| 5,037,096 | 8/1991 | Pinel, Jr. et al. | 473/126 |
| 5,074,553 | 12/1991 | Pawlowski et al. | 473/126 |
| 5,125,656 | 6/1992 | Fabanich | 473/126 |
| 5,215,304 | 6/1993 | Pinel, Jr. et al. | 473/126 |
| 5,389,042 | 2/1995 | Pinel, Jr. et al. . | |

*Primary Examiner*—William M. Pierce

*Attorney, Agent, or Firm*—Dorn, McEachran, Jambor & Keating

[57] ABSTRACT

A bowling ball has a heavy core of given density; the core has an asymmetrical shape that affords no planes of symmetry. The core is encompassed by a spherical shell of lower density; the shell may include two layers, a relatively hard outer layer of an acrylated resin or urethane resin and a more resilient, softer inner layer, usually of urethane or filled polyester resin. A balancing weight, to compensate for finger holes to be drilled into the shell, is preferably an integral part of the bowling ball core. The density of the balancing weight is usually greater than the density of the rest of the core.

6 Claims, 8 Drawing Sheets

320
X
303
321
300
304
302
305
313
306
Z
9
9
Y
Y
316
315
314
311
312
308
307
309
X

Z
320
300
305
321
314
303
313
Y
X
Y
311
312
302
304
316
315
Z

BOWLING BALL WITH ASYMMETRICAL CORE

BACKGROUND OF THE INVENTION

In accordance with the requirements of the American Bowling Congress ("ABC"), all bowling balls must conform to a limited size range regardless of weight variations, which may be in a range of six to sixteen pounds (2.72 to 7.26 kilograms). Most balls for use by adults have a weight of about sixteen pounds (7.26 kilos). A bowling ball, under ABC requirements, cannot contain metal components, though use of metallic compounds is permitted in the cores. As most manufacturers produce them, the principal differences between bowling balls of different weights are based on variations in the density (specific gravity) of their cores. Thus, the cores in a particular bowling ball construction are often all of the same size and shape, and the weight of the shell encompassing the core is about the same, though the shells may exhibit some weight variation. In virtually every bowling ball there is a balancing weight to compensate for finger holes drilled in the ball shell to accommodate the fingers used by a particular bowler in gripping the ball. The balancing weight is preferably a part of the core, but may be separate from the core.

The mechanics of a bowling ball moving down a lane toward the pins are complex and are not always well understood. As released by a typical high-scoring bowler, the bowling ball exhibits both linear (sliding) velocity, or speed, and rotational velocity. At release, the bowling ball is usually rotating about an axis determined by the bowler, an axis that may be quite different from any of the usually recognized axes of the ball. As the ball moves down the lane toward the pins the initially predominant linear motion tends to decelerate more rapidly, due to frictional engagement with the lane. Rotational movement shows less deceleration, but may change, both in amplitude and in regard to the axis of rotation.

The ABC does not specify limits for moments of inertia for a bowling ball, but does specify permissible maximum values for radii of gyration (RG) about three principal axes X, Y and Z. The Z axis is the "pin" axis of the ball; the X and Y axes are perpendicular to the Z axis and to each other. All three axes intersect at the center of gravity of the ball. ABC specifications also cover the differentials permissible between the RG values of a bowling ball about its axes. These differentials are limited to a maximum measured value of 0.080; there is no specified minimum measured differential value.

In bowling, the angle at which a bowling ball strikes the head pin is an important factor in the effect on the pins. That is why proficient bowlers prefer a ball that consistently describes a curve or "hook" as it approaches the pins. If the hook begins too soon or too late, as the ball moves down the lane toward the pins, the hook effect changes and the results may be quite undesirable or even disastrous.

The factors that affect the hook exhibited by a bowling ball are known, but their inter-relationships are not always fully understood. Most lanes are oiled in the area where the bowling ball first engages the lane; usually, however, the lane area adjacent the bowling pins is not oiled. Friction between the surface of the bowling ball and the lane does not cause the ball to hook, but it does affect the timing and extent of the hooking action. The speed of the ball affects the hook action; if ball speed is increased, the forces governing hook action are reduced. Broadly speaking, the slower the bowling ball rolls the more it will hook, and vice versa. The axis of the initial spin of the bowling ball (the spin created by the way the bowler releases the ball), and the rotational speed of that spin, both affect the hooking action. Indeed, ball rotational speed and the axis of rotation are perhaps the most significant factors affecting hook. Rotational speed, as imparted by the bowler, is not a factor that can be controlled by manipulation of the bowling ball structure; it depends on the bowler. The extent of lane oiling is also beyond control of the ball manufacturer. But the frictional characteristics of the outer surface of the bowling ball and the locations of the axes of the ball, as well as the RG values applicable to those axes, are subject to control by the manufacturer when the bowling ball is made. The present invention is concerned with those factors subject to control at the time of manufacture.

In many bowling ball constructions, the core is essentially spherical. A small balancing weight is provided to compensate for the finger holes, which holes are usually drilled at the time of sale to a particular bowler. The balancing weight may be a part of the core or it may be a separate element. A bowling ball with a symmetrical core has no particular location for a preferred spin axis (PSA); the PSA position is inconsistent and unpredictable. The PSA is likely to shift when the finger holes are drilled; the dynamic characteristics of the ball are still random and unpredictable.

Bowling ball cores of rather unusual configurations have been proposed and used; most seem to be based on empirical determinations or even just plain guesswork. A bowling ball core that is asymmetrical, but may have one "mirror plane", so that the RG values are different for all axes of the ball, is a substantial improvement. Static imbalances and weight voids have less effect on the bowling ball reaction. When the bowling ball is drilled, its PSA shifts only slightly; the ball is more predictable than one which has a truly spherical core. But the PSA is still subject to some change.

STATEMENT OF THE INVENTION

This invention is predicated on the conclusion that a truly asymmetrical core, having no mirror planes, is the best core for a bowling ball that is to be drilled for finger holes after its manufacture, in circumstances such that drilling may be carried out by relatively unskilled personnel. The dynamic characteristics of such a bowling ball do not change appreciably when the ball is drilled; the PSA does not change position to a major extent regardless of where the ball is drilled.

It is an object of the invention, therefore, to provide a bowling ball that has and retains a substantially constant position for a preferred spin axis (PSA) regardless of where the ball is drilled for finger holes.

Another object of the invention is to provide a bowling ball construction in which the dynamic characteristics are constant and which affords improved, consistent hook potential and track manageability.

Accordingly, the invention relates to a bowling ball comprising a core having a predetermined uniform core density $d_c$. A shell encompasses the core, the shell having a spherical external configuration and a preselected uniform shell density $d_s$. The core density $d_c$ is larger than the shell density $d_s$. The core has an asymmetrical configuration that has no plane of symmetry.

DESCRIPTION OF THE PREFERRED EMBODIMENTS

Before proceeding with a description of FIGS. 1 through 4, it is useful to present a definition of a term used in this description; that term is "plane of symmetry". As employed in this specification "plane of symmetry" means a plane on which a bowling ball core could be cut to provide either truly symmetrically shaped core halves or to provide core halves that are mirror images of each other. That is, "plane of symmetry" as used herein includes a "mirror plane".

In FIGS. 1 through 4, the drawings are presented in rectilinear form because it is easier to illustrate and visualize a cube or a rectangle, in a planar drawing, than it is to show a sphere. This consideration applies to all of FIGS. 1 through 4 but is not applicable to FIGS. 5–9. In column I in each of FIGS. 1, 2A, 3A and 4, a core is depicted that starts as a cube; that illustration is also intended to be representative of a spherical core. In column II of FIGS. 1 and 4 and in columns II and III of FIGS. 2A and 3A the core is shown as a rectilinear figure having four sides that are all congruent rectangles and two ends that are squares. This corresponds generally to a rod-shaped core of circular cross-section with hemispherical ends. In column III of each of FIGS. 1 and 4, and in FIGS. 2B and 3B, the core starts as a rectilinear solid figure having no square sides and with no side having the same area as either of the adjacent sides. This would correspond generally to a somewhat flattened rod (oblate spheroid cross section) having rounded ends. Views of some of the core configurations are omitted to keep the drawings, FIGS. 1 through 4, to a reasonable number.

Figure 1:
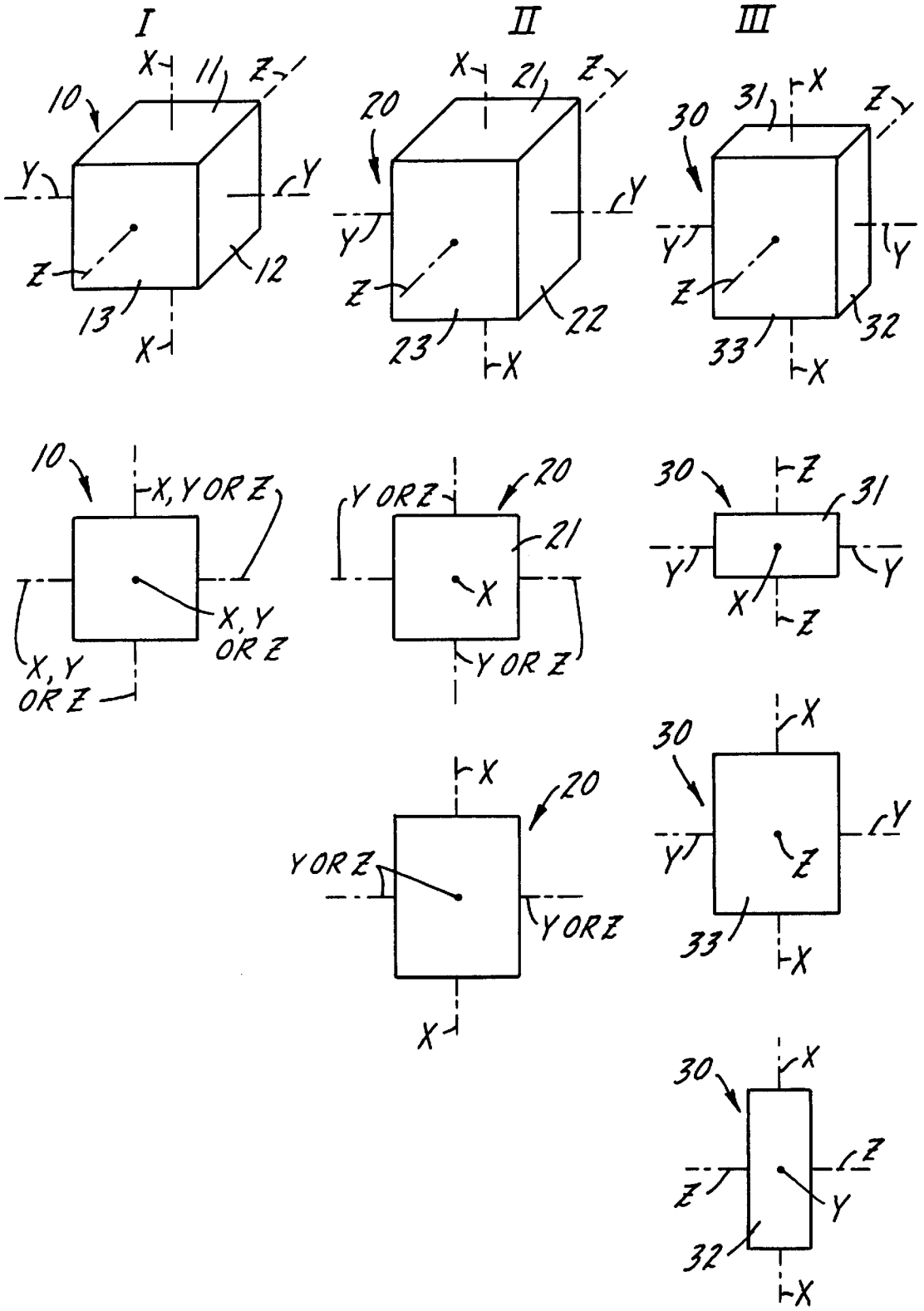
FIGS. 1, 2A, 2B, 3A, 3B, and 4 are all diagrammatic views using rectilinear illustrations to explain different possible core configurations for a bowling ball, including cores shaped in accordance with the invention.

Starting at the top of column I in FIG. 1, the orthagonal core configuration 10 shown there is a cube with each of the three illustrated surfaces 11, 12 and 13 all having the same dimensions. All are planar surfaces. The remaining three sides of the cubical core 10, the sides not illustrated, would have the same flat, square configuration. Thus, the next view down in column I of FIG. 1 is representative of any of the six side surfaces of the cubical core 10, including its top and its bottom. The three axes X, Y, and Z of core 10 are essentially interchangeable, as indicated in the bottom view in column I of FIG. 1. These three axes are better identified in the orthagonal illustration at the top of column I of FIG. 1. The three axes X, Y and Z would all intersect at the center of gravity of cube 10.

The rectangular core 20 illustrated in column II of FIG. 1 is generally similar to core 10 of column I but not quite the same. The top surface 21 of core 20 is again a square; the bottom of core 20 would have the same configuration so that the second drawing down in column II may be taken to represent either the top surface 21 or the bottom surface of core 20. The sides 22 and 23 of core 20 are the same size and of the same rectangular shape; they are not square. The sides of core 20 that do not appear in the uppermost view of column II in FIG. 1 would have the same size and shape as sides 22 and 23. Accordingly, the bottom view in column II of FIG. 1 is also representative of core 20 as viewed from any of its four vertical sides. Again, the X, Y and Z axes intersect at the center of gravity of core 20.

The rectangular core 30 illustrated in column III of FIG. 1 has been changed further, though it is still related to the cores shown in columns I and II. Thus, core 30 has one narrow side 32 and one wide side 33. As a consequence, the top surface 31 of core 30 is a rectangle; top 31 is similar in shape to side 32 but has one different dimension. Side 32 of core 30 may be considered to be the "narrow" side and side 33 may be termed the "wide" side. The top and bottom views for core 30 would be the same and would be as represented in the second illustration in FIG. 1, column II. The wide side of core 30, whether viewed from the front or from the back, would be as illustrated in the third part of FIG. 1, column III. The narrow side of core 30, regardless of whether viewed from the right or from the left, would look like the shape shown in the bottommost illustration of column III of FIG. 1.

All of the cores illustrated in FIG. 1 have a large, virtually infinite, number of planes of symmetry. Thus, a plane along any intersecting pair of axes, such as the axes XY, XZ, and YZ in column I of FIG. 1, would separate core 10 so that the two halves of the core resulting from the severance would be the same, provided the density of core 10 is consistent. Additional planes of symmetry exist across all of the diagonals of core 10. Indeed, any plane through the intersection of axes X, Y and Z would be a plane of symmetry as defined above. If core 10 were spherical, the number of planes of symmetry would also be infinite because any plane cutting the sphere through its center would result in symmetrical core halves. The number of planes of symmetry are the same for cores 20 and 30 shown in columns II and III of FIG. 1. Thus, for any of these rectangular cores, severance of the core along a plane coincident with any pair of the axes X, Y and Z would produce symmetrical core halves. The same thing would apply with respect to any planes extending diagonally across the corners of a side of any one of these cores and with respect to any plane through the intersection of the core axes.

Figure 2A:
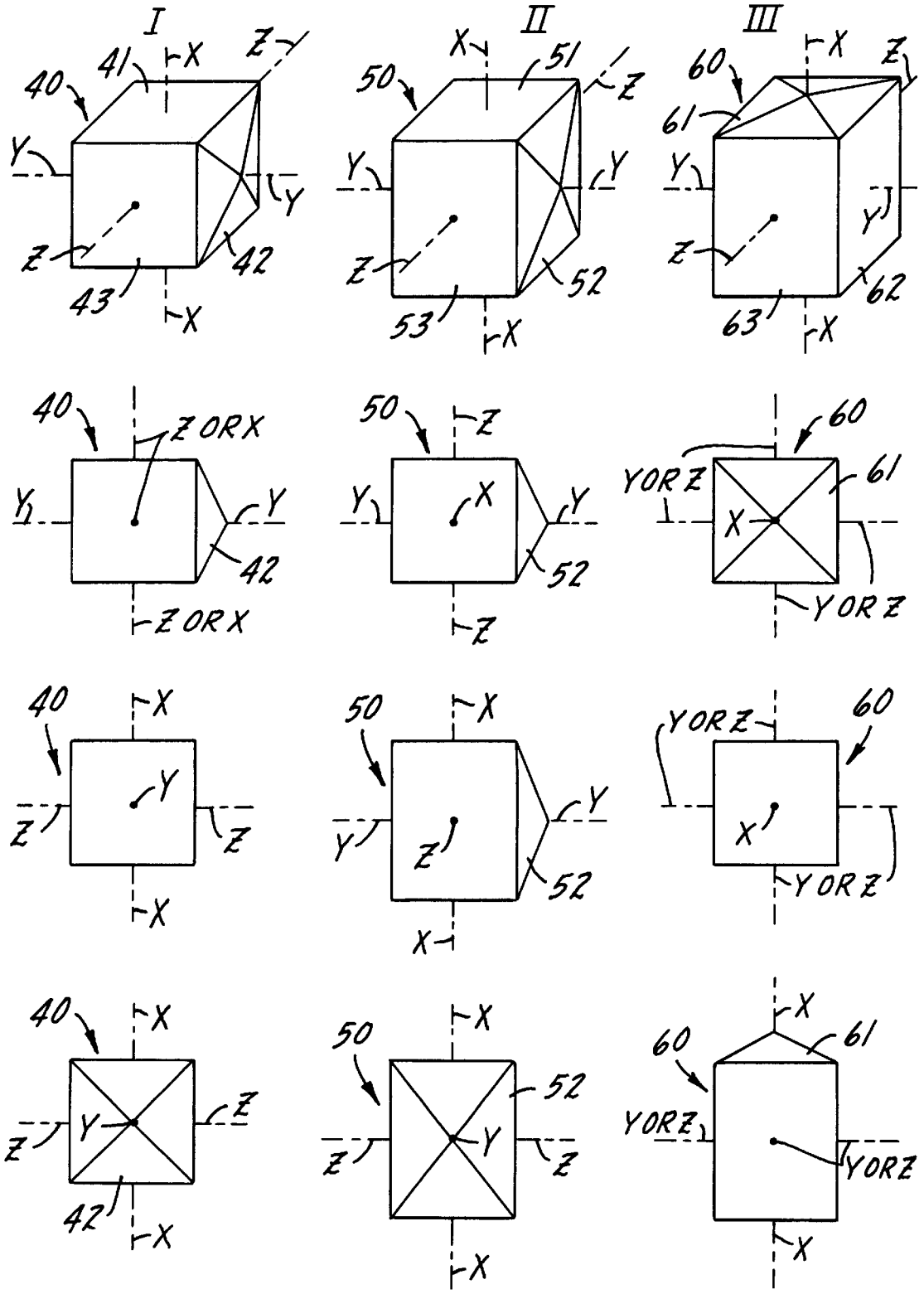

The orthagonal drawing at the top of column I in FIG. 2A represents a core 40 that is essentially cubical and hence corresponds in most respects to core 10 of column I in FIG. 1. The top surface 41 is planar; this applies equally to the bottom surface of core 40. The front surface 43 of core 40 is also an unmodified plane; the rear surface of this core would also be planar. The side surface 42 of core 40, however, is modified to have a generally pyramidal protuberance. Thus, side 42 of core 40 is not flat. The left hand side of core 40, on the other hand, is flat, just as in the case of core 10 of column I, FIG. 1.

The next figure down in column I of FIG. 2A is a top or plan view of core 40. The bottom view of core 40 would be the same, as would front and rear views. The only difference between this view and the next view down in column I of FIG. 1 is that the bulging side surface 42 appears in one (upper) view and is not seen in the other. Thus, the third figure down in column I of FIG. 2A represents the left hand side of core 40, the side opposite side 42. The surface is shown to be planar, with no bulge. The lowermost figure in column I of FIG. 2A, on the other hand, is a side elevation view that illustrates the pyramidal bulge of side 42 of core 40.

Column II in FIG. 2A starts, at the top, with an orthagonal view of a core 50 that has the same basic shape as core 20 in column II of FIG. 1. The top surface 51 of core 50 is a square, and surface 51 is planar. The front surface 53 is a rectangle and again has a planar configuration. The side surface 52 of core 50, however, is modified so that it bulges outwardly; the bulge is shown as having a generally pyramidal configuration. The side of core 50 opposite side 52 (not shown) is an unmodified plane. Thus, core 50 corresponds essentially to core 20 in column II of FIG. 1 except that side 52 of core 50 has a pyramidal bulge.

The second illustration down in column II of FIG. 2A is a plan view of core 50, showing the bulge of side 52. The bottom view of core 50 would be the same. The third view down in column II of FIG. 2A is a front view of core 50, again showing the bulge at side 52. The rear view would be the same. The bottom illustration in column II of FIG. 2A is taken from the bulged side 52 of core 50. The opposite side of the core, not shown, would be the same except that there would be no bulge.

Column III of FIG. 2A, in the top orthagonal view, illustrates a core 60 that is closely related to core 20 of column II in FIG. 1 but with one modification. Thus, the sides 62 and 63 of core 60 are again rectangular and planar; they have the same configuration. The top surface 61 of core 60 is square but has a bulge, shown as being of pyramidal configuration. That is, the bulging top surface 61 of core 60 has a configuration like the side surface 42 of core 40 in column I of FIG. 2A. The next figure down in column III of FIG. 2A is a top view of core 60, showing the bulging surface 61. The next view in column III of FIG. 2A is a bottom view of core 60. The lowermost illustration in column III of FIG. 2A is an elevation view that is representative of any of the four vertical sides of core 60, surmounted by the bulging top 61.

With respect to planes of symmetry, the situation is different for cores 40, 50 and 60 of FIG. 2A than for the basic cores 10 and 20 of FIG. 1. Thus, each of cores 40 and 50 can be severed along planes coincident with the XY and YZ axes to produce core halves that are fully symmetrical duplicates. Core 60 can be severed along planes coincident with the XZ and XY axes with the same result. This is not true, however, with respect to severance of cores 40 and 50 along the XZ axes, or severance of core 60 along a plane coincident with its Y and Z axes, due to the presence of the bulging surfaces 42, 52 and 61. It is also possible to produce symmetrical core halves by severing each of cores 40, 50 and 60 along two diagonal planes intersecting at the corners of their bulging core surfaces 42, 52 and 61. A plane coincident with the remaining diagonal, however, would produce core segments that are not symmetrical.

Figure 2B:
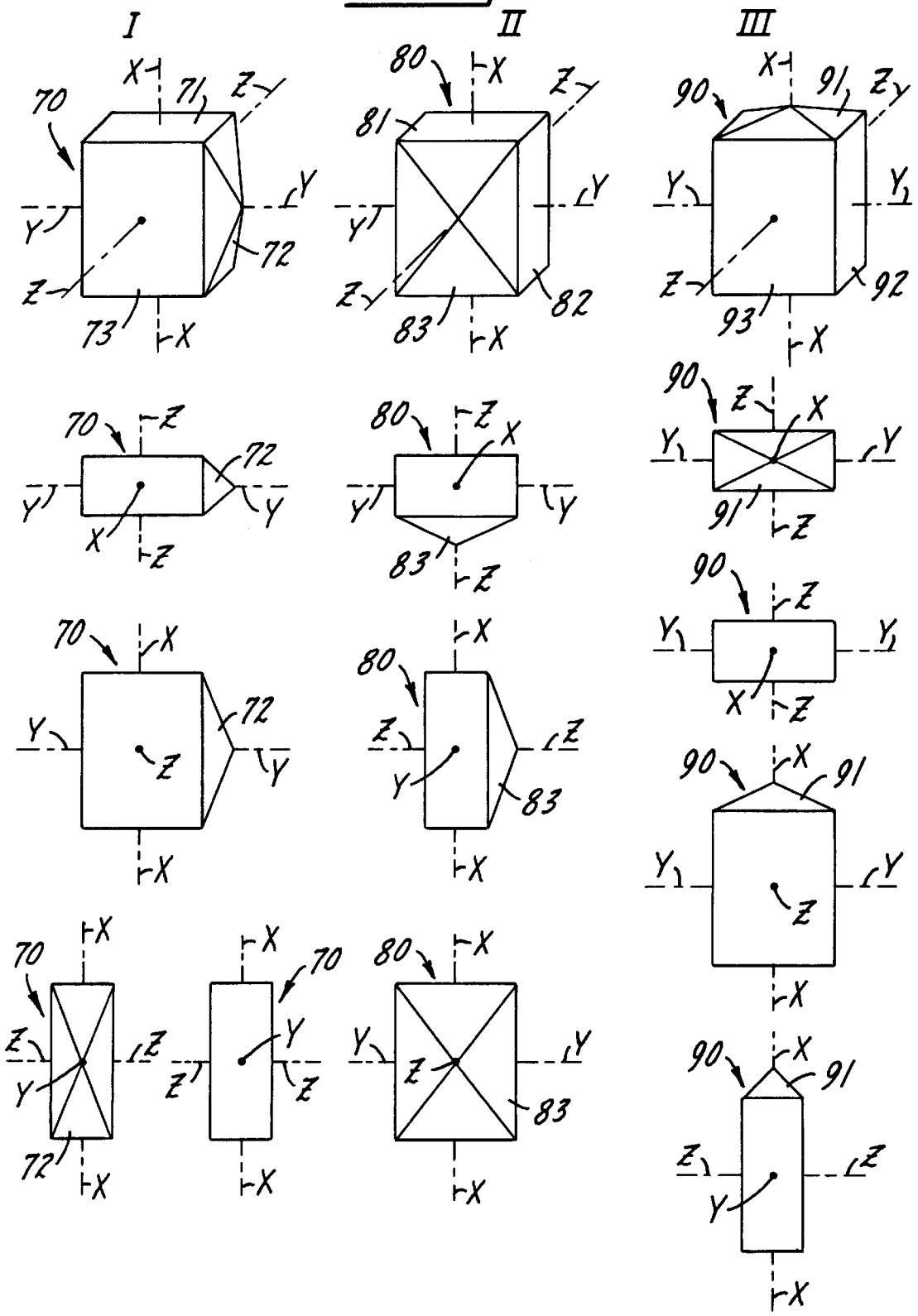

The orthagonal drawing appearing in the top level of each of columns I, II and III in FIG. 2B illustrates a core that has the same basic shape as core 30 in column III of FIG. 1. However, the three cores 70, 80, and 90 shown in FIG. 2B each have one surface that has been modified to bulge outwardly. In each instance, the bulge is shown as having a generally pyramidal configuration. Thus, in core 70 of FIG. 2B column I the top surface 71 and the front surface 73 are still planar but the surface 72 has a pyramidal bulge. Similarly, core 80 in FIG. 2B column II has planar top and side surfaces 81 and 82 but the front surface 83 is bulged outwardly; again, the bulge is shown as having a pyramidal configuration. The core 90 of FIG. 2B column III, on the other hand, has two planar side surfaces, the narrow side 92 and the wide side 93, but the top surface 91 has been bulged outwardly with the bulge being shown as being of pyramidal configuration.

In column I of FIG. 2B, the second figure from the top is a plan view of core 70; the same shape would be exhibited by a bottom view. The narrow bulging side 72 would appear in both. The next figure down in column 1 is representative of the two wide sides of core 70, from which the bulging surface 72 would be visible. Thus, this illustration applies to both the front and the rear of core 70. At the lowest level in column I, the left hand figure is an elevation view of core 70 showing the bulging narrow side 72. The adjacent figure shows the same core 70 as it would appear from its other narrow side.

The same general arrangement is followed in column II of FIG. 2B. The second illustration down in column II shows either the top or the bottom of core 80, along with the bulging wide side 83. The next figure down is representative of both the right and left hand (narrow) sides of core 80, again showing the bulge of the wide core side 83. The lowermost figure in column II of FIG. 2B is a front elevation view of core 80 that illustrates the pyramidal bulge of wide side 83. The opposite side of core 80 would have the same configuration, but with no bulge.

As to column III of FIG. 2B, the second drawing down from the top is a plan view of core 90 showing the pyramidal bulge of the upper surface 91. The next view down is similar, showing the bottom of core 90, which is a planar surface without the pyramidal bulge. Continuing downwardly in column III of FIG. 2B, there is a drawing that is representative of the front and rear sides of core 90, with the bulging top 91 shown in the drawing. The lowermost view in FIG. 2B column III is taken from either of the narrow sides of core 90, with the pyramidal bulged top 91 again appearing.

The core configurations illustrated in FIG. 2B columns I–III have the same basic characteristics, with respect to symmetry, as those of FIG. 2A. If core 70 is severed along planes coincident with the XY and YZ axes, the core halves are symmetrical with respect to each other. That is not true of a plane coincident with the X and Z axes. Two other symmetrical severance planes can be produced by cutting core 70 along the diagonals of the narrow side 72 of the core that has the pyramidal bulge, producing core halves that are symmetrical. The remaining diagonal cutting planes available with core 70 do not produce symmetrical core halves, due to the presence of the bulge on one side of the core. The same considerations apply to core 80 except that only axes pairs XZ and YZ define planes of symmetry. For core 90 it is only the axes pairs XY and XZ that define planes of symmetry.

Figure 3A:
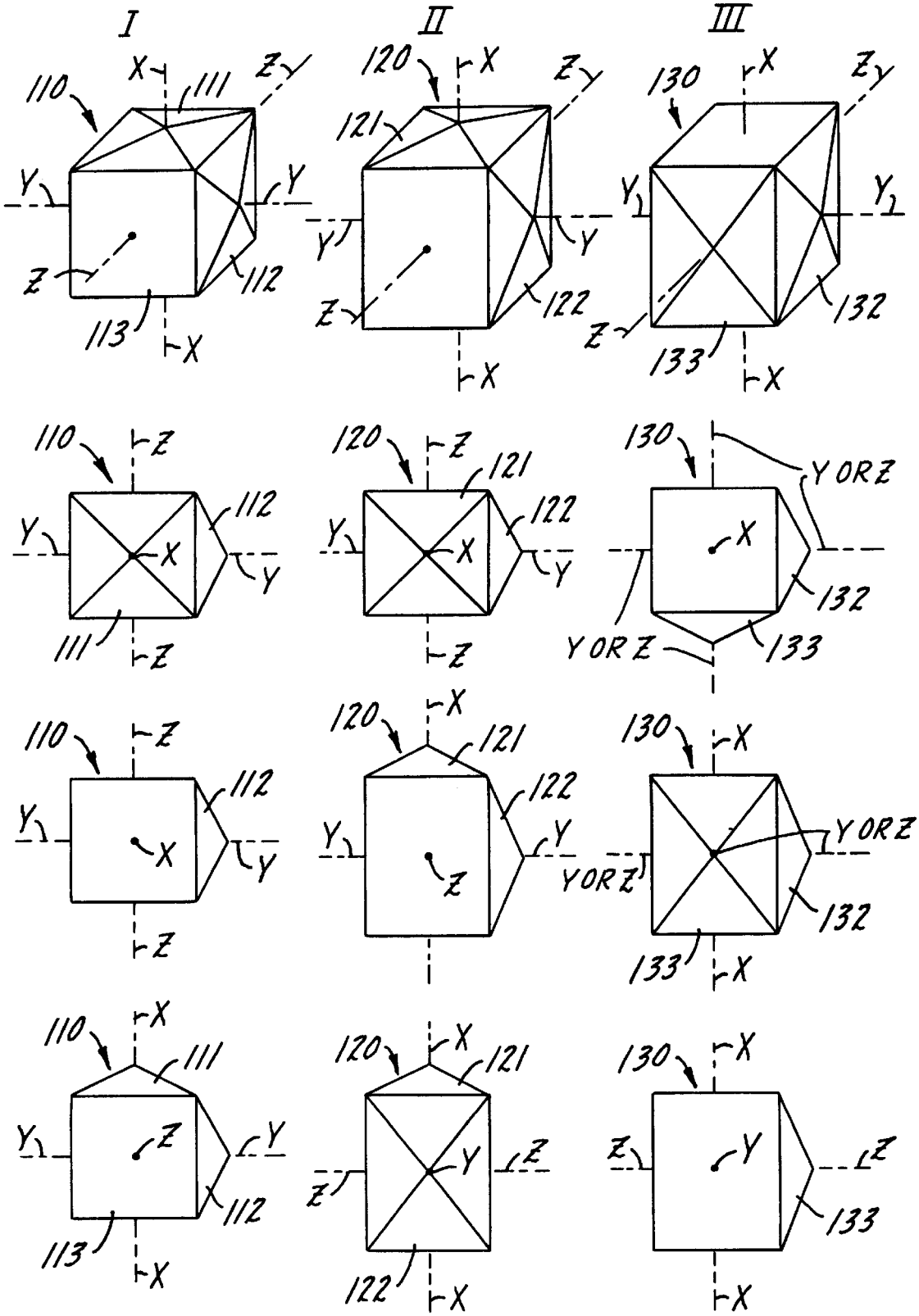

The cores 110, 120 and 130 shown in orthagonal views at the top of columns I–III of FIG. 3A are generally similar to the cores shown in the three top views of FIG. 2A except that in FIG. 3A there are bulges on two sides of each core so that cores 110, 120 and 130 are more asymmetrical that cores 40, 50 and 60. Referring to core 110, as shown in the four views of column I in FIG. 3A, it is seen that the front face 113 of this cubical core remains planar but that each of the top and side faces 111 and 112 is bulged outwardly; as before, the bulges are shown as being of pyramidal configuration. The next view down in column I is a top view featuring the two pyramidal bulged surfaces 111 and 112 of core 110. This illustration could also be applied to a view taken from the right hand side of core 110 as depicted in the top orthagonal view. The next illustration down in column I shows the bottom of core 110, in which only the one non-planar side 112 appears. This illustration would apply equally to a front view of core 110. The lowermost illustration in column I of FIG. 3A can be applied to either of the left hand and rear sides of core 110. Bulging surfaces 112 and 111 appear. It can be demonstrated that the only axial plane of symmetry for core 110 of FIG. 3A, column I is a plane coincident with the X and Y axes; that is, division along this plane results in two symmetrical core halves. In addition, there is only one diagonal plane that can divide core 110 into two symmetrical halves; that would be a plane taken along the diagonal from the upper right hand corner to the lower left hand corner of side 113.

The second figure down from the top in column II of FIG. 3A is a plan view of core 120 showing the bulges for the top 121 and the one side 122. This view would be the same from the bottom of core 120 except that the surface facing outwardly would be planar. The next view down in column II of FIG. 3A is a front view that again shows both of the asymmetrical surfaces 121 and 122. The view would be the same from the rear of core 120. Finally, at the bottom of column II in FIG. 3A there is an illustration taken from the bulging right hand side 122 of core 120. Top 121 is in view. The same appearance would be apparent in a rear view except that there would be no visible bulge on the side of the core.

In column III of FIG. 3A, the drawing immediately below the orthagonal figure at the top of the column is a top view of core 130; both bulging sides 132 and 133 appear. The view would be the same from the bottom of the core. The next (third) figure down in column III of FIG. 3A is a side elevation view taken from the asymmetrical side 133 of core 130. This view also represents core 130 as it would be seen from the right hand side, looking toward surface 132. At the bottom of column III in FIG. 3A there is a side elevation view that is representative of both of the planar (non-illustrated) sides of core 130.

Figure 3B:
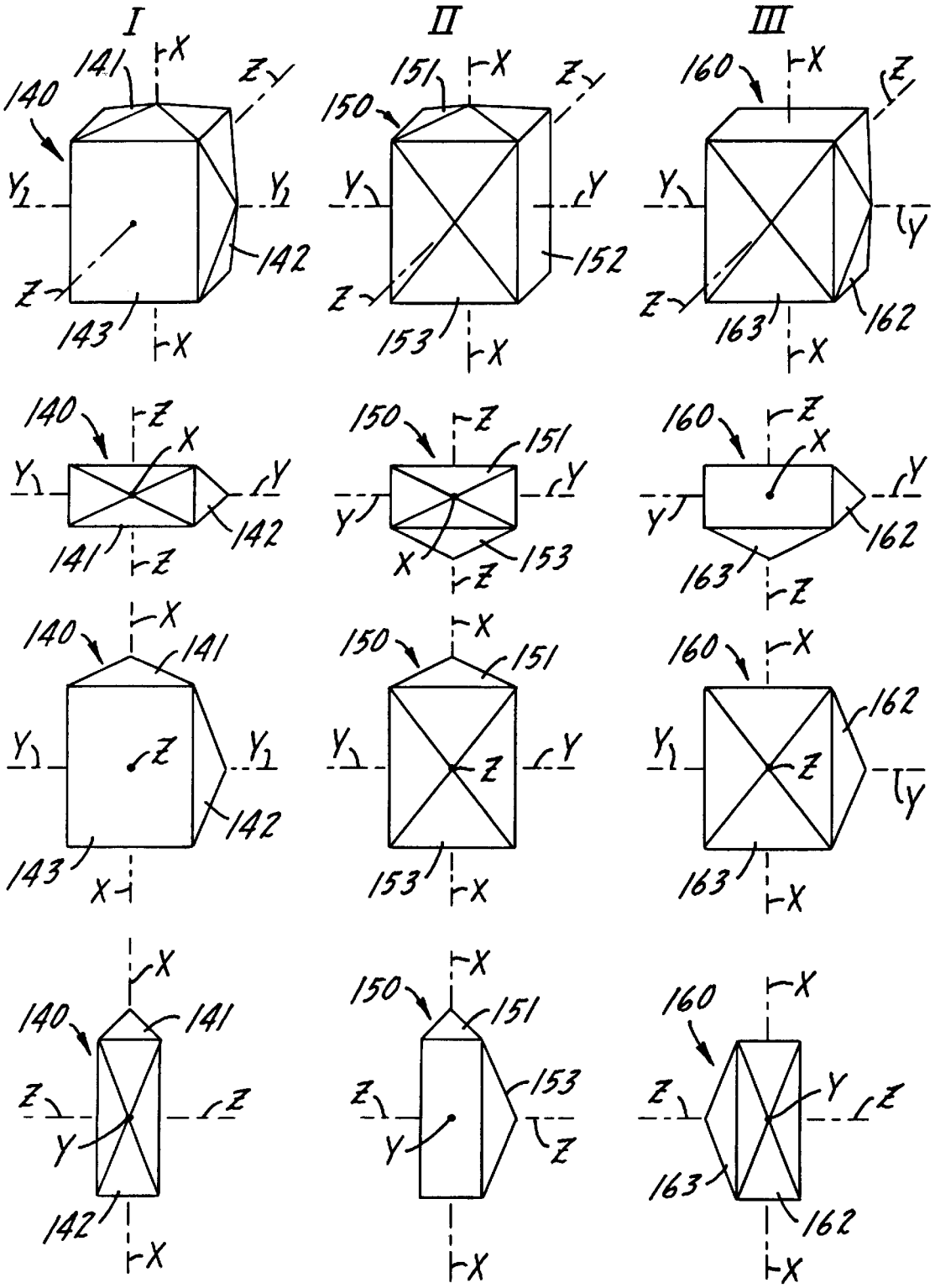

FIG. 3B is basically similar to FIG. 2B except that the three orthagonal cores illustrated at the top of each of the columns I, II and III in FIG. 3B, cores 140, 150 and 160, each have two asymmetrical surfaces. In each instance, the asymmetrical surface is shown as an outward pyramidal bulge.

In column I of FIG. 3B, the second figure from the top shows the outwardly bulging top surface 141 and the narrow pyramidally bulging side surface 142 of core 140. This illustration would be the same for a bottom view of core 140 except that the surface of the core facing outwardly of the drawing would be planar rather than pyramidal. The next (third) drawing down in column I of FIG. 3B is a front view of core 140, from the wide side 143; it would also be representative of the rear view of the same core. Bulged sides 141 and 142 appear. In the lowermost level of column I in FIG. 3B, there is a narrow side elevation view of core 140, showing the two bulging sides 141 and 142. This would be representative of the other narrow side of core 140 if there were no indication of a bulge on the face of the core.

The view immediately below the orthagonal illustration at the top of column II in FIG. 3B is a plan view of core 150 which has outwardly bulging surfaces at the top 151 and the core's wide side 153. The bottom view of core 150 would be the same except that there would be no indication of a pyramidal bulge; the bottom of core 150 is planar. Continuing downwardly in column II of FIG. 3B, there is a front elevation view of core 150, including the outwardly pyramidally bulged front (wide) surface 153 as well as the upwardly projecting bulge of top surface 151 of the core. This view would be the same for a rear view of core 150 if there were no indication of a bulge on the wide surface of the core. At the bottom of column II of FIG. 3B there is a narrow side elevation view of core 150 that is applicable to both of the narrow sides of the core because those two surfaces have no bulges.

In the final column III of FIG. 3B, the first view down from the orthogonal illustration at the top of the column shows core 160 with the front pyramidal bulge on its wide side 163 and the side pyramidal bulge on narrow side 162 of the core. The illustration would be the same for the bottom of core 160. The next (third) figure down in column III of FIG. 3B is a front elevation view that shows the wide bulged side 163 of the core and the narrow bulged side 162. The view from the rear of core 160 would be the same as this figure except that there would be no bulge on the surface facing outwardly of the drawing. At the bottom of column III in FIG. 3B there is a side elevation view of core 160, taken from the narrow bulged side 162 of the core. The view from the opposite side of core 160 would be the same except with no bulge on the narrow core surface.

With respect to planes of symmetry, the cores of FIG. 3B are much like those of FIG. 3A. That is, in each of the three cores illustrated in FIG. 3B, only one plane coincident with any two of the X, Y and Z axes can be used to sever the core so that symmetrical core halves are produced. For core 140 the only axial plane of symmetry is the XY plane; for core 150, only the axial plane XZ produces symmetrical core halves; for core 160 the only axial plane of symmetry is the YZ plane. However, there is one other difference. It is not possible to sever any of the cores 140, 150 and 160 of FIG. 3B along a diagonal so as to produce matching core halves. In this respect, the cores of FIG. 3B are less symmetrical than the cores of FIG. 3A.

Figure 4:
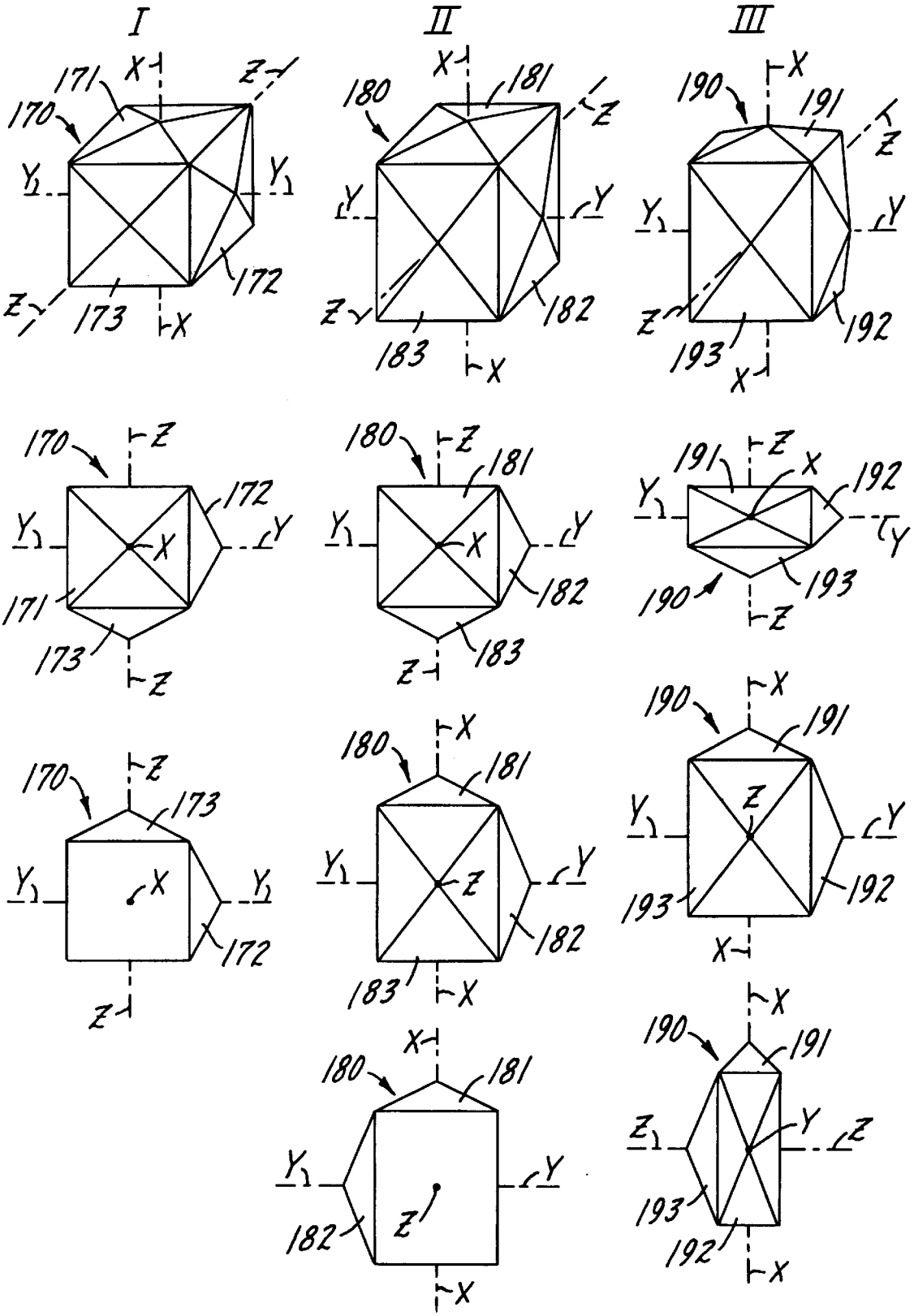

FIG. 4 contains three columns I, II and III in which, at the top of each column, there is an orthagonal illustration of a core construction closely related to the cores shown in the uppermost views in columns I, II and III of FIG. 1. However, the cores of FIG. 4 differ from those of FIG. 1 in that each has three surfaces that are non-planar. In each of the three cores 170, 180 and 190 of columns I, II and III, respectively, the altered surfaces are shown as outward pyramidal bulges and the three bulged surfaces are each contiguous with the other two. Thus, in core 170 of column I in FIG. 4, the top surface 171, the right hand face 172, and the front face 173 are each provided with a bulge shown as a pyramidal outward extension of the core surface. The basic configuration for core 170 is still that of a cube. The same situation applies to the rectangular core 180 with its top 181, right hand side 182, and front side 183; sides 182 and 183 have the same rectangular size and shape. In the rectangular core 190 of column III in FIG. 4, there are bulges in its top 191, right side 192, and front 193; all three sides have different rectangular configurations.

The middle figure in column I of FIG. 4 illustrates core 170 from the top 171. However, the view would be the same looking at core 170 from either of the two bulging faces 172 and 173. The third figure in column I of FIG. 4 is a bottom view of core 170. However, this view would be the same for cube 170 as viewed from the left hand side or from the rear, where planar surfaces are presented. Core 170 has no axial planes of symmetry. That is, it is not possible to cut core 170 along a plane defined by any of the axis pairs XY, XZ, or YZ and have the separated core halves correspond to each other. On the other hand, if the pyramidal bulges for surfaces 171, 172, and 173 of core 170 are all the same, then there are diagonal planes that could be used to separate core 170 so that the two separate portions of the core are equal to each other in size and shape. However if its bulges are all different, then core 170 has no planes of symmetry.

The second figure down in column II of FIG. 4 is a top or plan view of core 180, showing all three of the bulging sides 181, 182, and 183. A bottom view of core 180 would be the same except that there would be no indication of a bulge because the core bottom is a planar surface. The next figure down in column II of FIG. 4 is a front elevation view that also shows all three of the bulging (pyramidal) surfaces 181, 182 and 183. This view would be essentially unchanged for a side elevation view taken along the Y axis, looking at surface 182 of core 180. For any of the planar sides of core 180, an elevation view would be as shown in the lowermost figure of column II in FIG. 4.

With respect to column III of FIG. 4, the first view below the orthagonal illustration of core 190 shows that core from the top; all three of the bulging sides 191, 192 and 193 appear. A bottom view of core 190 would be the same except that the rectangular surface would not indicate a pyramidal bulge because there is none on the bottom of core 190. The next view down in column III of FIG. 4 is a front elevation view of core 190, showing the wide front surface 193 and its bulge. A rear elevation view of core 190 would be the same except that there would be no indication of a pyramidal bulge. The lowermost drawing in column III of FIG. 4 is an elevation view looking toward the narrow side 192 of core 190 along axis Y. The view from the other side of the core would be the same except that there would be no indication of a pyramidal bulge because the side of core 190 opposite side 193 is planar.

All three of the cores 170, 180 and 190 of FIG. 4 are fully asymmetrical. They have no planes of symmetry. That is, cores 170, 180 and 190 cannot be cut along any axial plane to divide the core into two matched halves. Furthermore, they cannot be severed along diagonal planes to afford matching, equal core halves.

FIGS. 1, 2A, 2B, 3A, 3B and 4 are far from exhaustive with respect to the possibilities of obtaining asymmetry in a bowling ball core, whether considered from the starting point of a cube or a sphere. Thus, for each of the cores illustrated in FIGS. 2A through 4 only a limited number of possible locations for the pyramidal bulges have been shown. Those bulges may have entirely different shapes and may be very different from each other. Moreover, the asymmetrical surfaces of the cores do not necessarily project outwardly from anything remotely resembling a sphere or a cube. Core surfaces may be made asymmetrical by depressions instead of bulges. Different sides may be selected for bulges or depressions; those shown are merely representative. Bulges or depressions may be quite asymmetrical. Further, in all the foregoing discussions it has been assumed that the composition of the core is essentially uniform and that its density does not change. Asymmetry could be introduced by weight differences (differences in density) as well as by changes in geometry. However, except for balancing weights, it is preferable to maintain a relatively consistent composition for a bowling ball core in order to keep the manufacturing process as inexpensive as possible.

Figure 5:
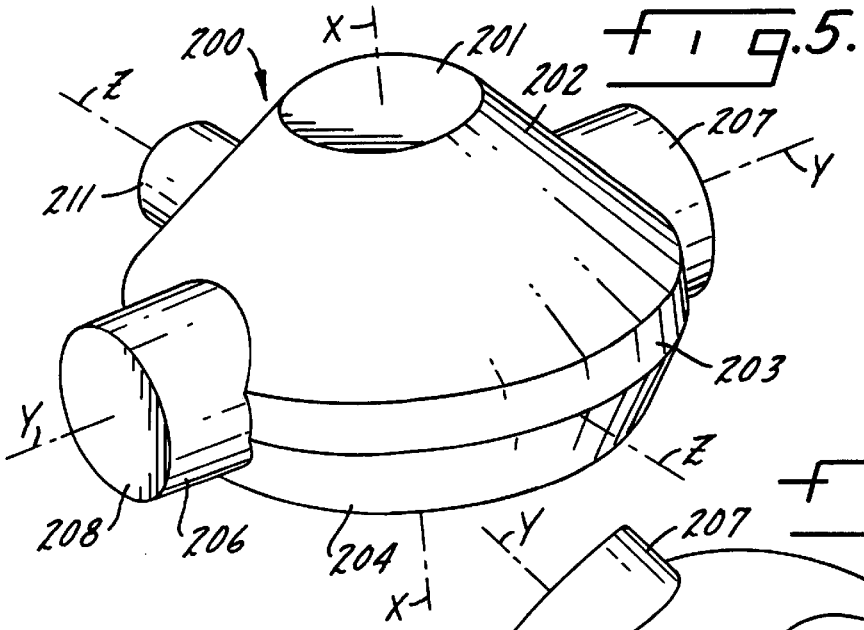
FIGS. 5, 6 and 7 are three different perspective views of a bowling ball core constructed in accordance with a preferred embodiment of the invention.
Figure 6:
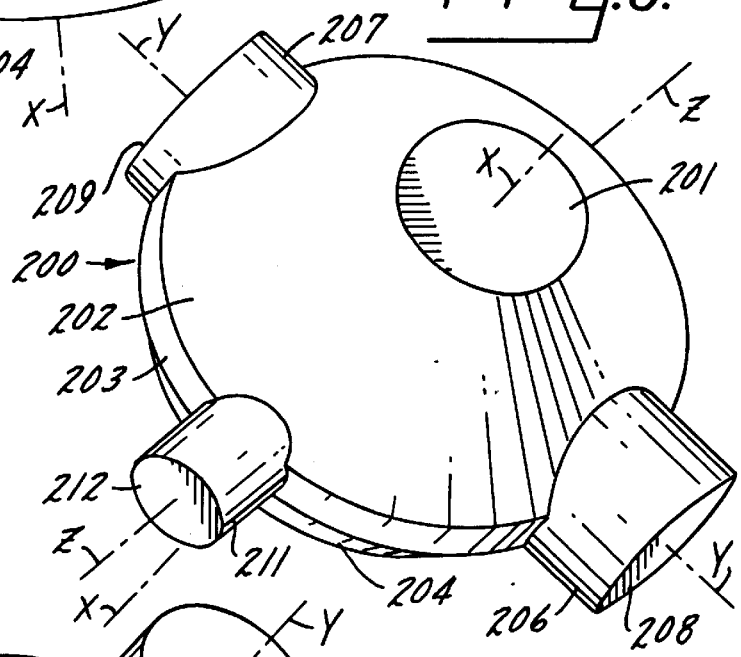
Figure 7:
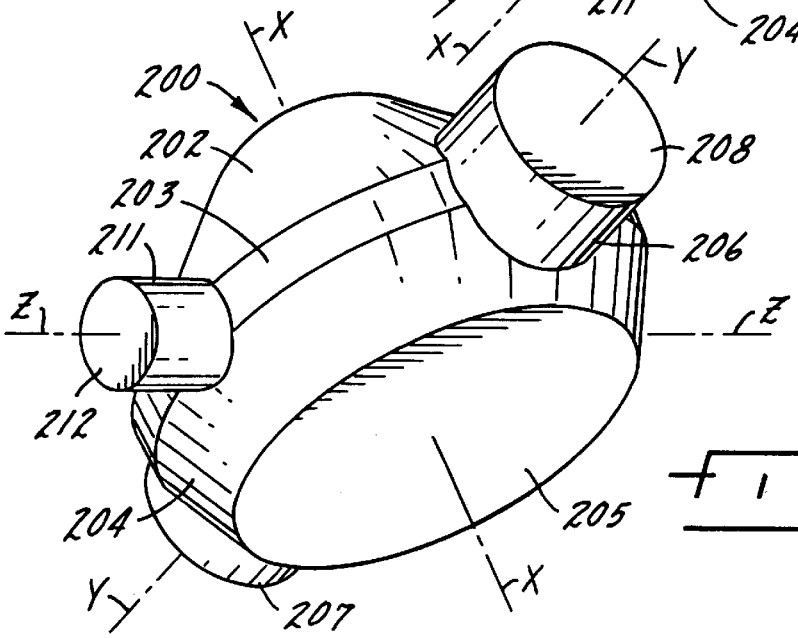

FIGS. 5, 6 and 7 are all perspective views of a bowling ball core 200 that has no plane of symmetry. The top 201 of core 200 (FIGS. 5 and 6) is a planar surface of circular configuration. Top surface 201 is the outermost surface of a truncated cone 202 that terminates, in the center of core 200, in a slightly dished circular band 203 (FIGS. 5–7). On the opposite side of core 200 there is another frusto-conical surface 204 that ends in a circular, outwardly facing planar surface 205. Surface 205 of core 200 (FIG. 7) is larger than surface 201 (FIGS. 5 and 6). The X axis of core 200 goes through the center of each of the core surfaces 201 and 205.

There is a rod-like projection 206 at one side of bowling ball core 200 and another rod-like projection 207 at the opposite side of the core. The two projections 206 and 207 are approximately coaxial (axis Y) and the diameters of those two projections may be approximately equal, as shown, but the overall axial length of projection 206 is larger than the axial length of projection 207. Projection 206 ends, at its outer end, in a surface 208 that is perpendicular to axis Y; similarly, projection 207 has a circular outer surface 209 that is planar and that is perpendicular to axis Y. There is a third rod-like projection 211 centered on the Z axis of core 200. Projection 211 has a smaller diameter than projections 206 and 207 and terminates in an outer surface 212 that is perpendicular to the Z axis of the core, as seen in FIGS. 6 and 7.

Core 200 and its projections 206, 207 and 211 are all molded in one piece of a mixture of a relatively inert (non-reactive) resin with clay or other mineral filler. The filler is varied to achieve a desired ball weight. One of the core projections is preferably a balancing (top) weight for the bowling ball in which core 200 is used; it is formed with a higher density than the rest of the core. In core 200, projection 206 is the preferred location for the balancing weight.

Figure 8:
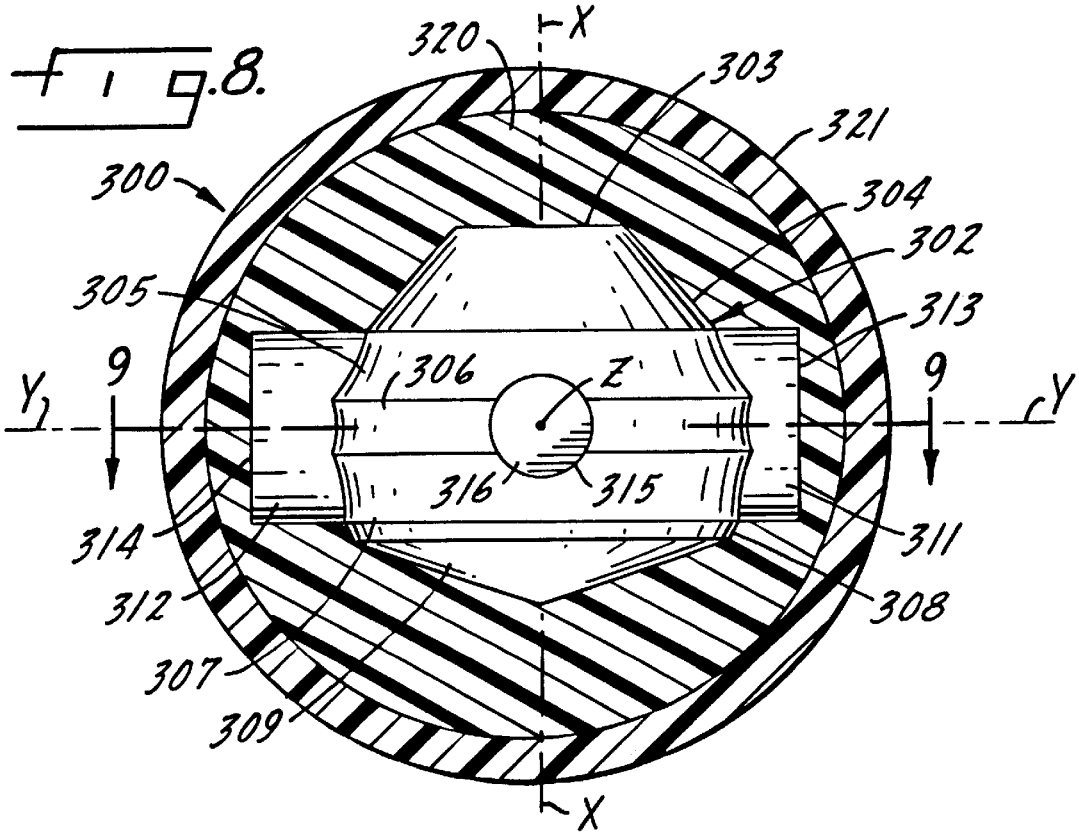
FIG. 8 is a sectional view of a bowling ball incorporating a core similar to but specifically different from the core construction of FIGS. 5–7.
Figure 9:
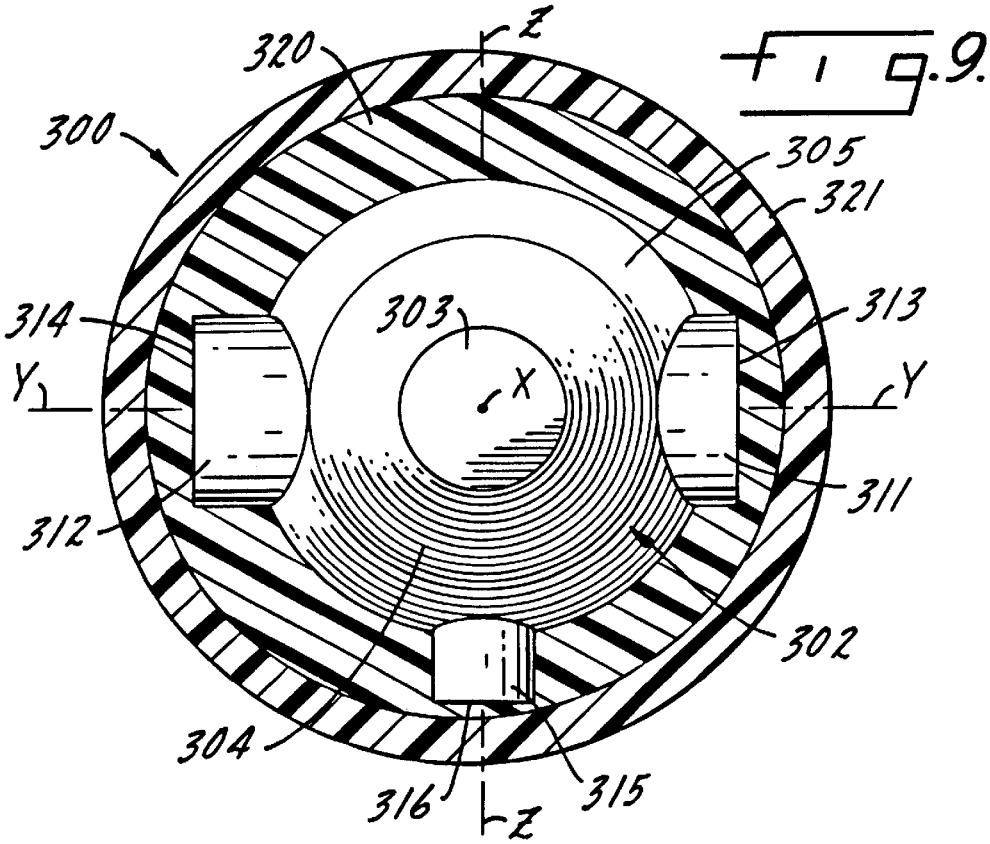
FIG. 9 is a sectional view taken approximately along dash line 9—9 in FIG. 8.

FIGS. 8 and 9 are sectional views of a bowling ball 300 that incorporates a core 302. Core 302 is similar to but specifically different from the core 200 of FIGS. 5–7. Core 302 has a planar top surface 303 of circular configuration that is the outer surface of a truncated cone 304. Frusto-conical core element 304, at its end opposite surface 303, connects to a dished-out conical surface 305 that in turn connects to a slightly concave circular band 306 around core 302. The bottom half of core 302, as seen in FIG. 8, comprises a concave frusto-conical surface 307 succeeded by a smaller frusto-conical surface 308 ending in a cone 309. All of the surfaces 303–309 are centered on the X axis of core 302.

Core 302 of bowling ball 300, FIGS. 8 and 9, further comprises two integral rod-like projections 311 and 312. Projections 311 and 312 have approximately equal diameters and are coaxial with respect to the Y axis of bowling ball 300. Projection 311 terminates at an outer surface 313 perpendicular to axis Y; projection 312, which is longer than projection 311, ends at an outer surface 314 that also is normal to the Y axis. The balancing weight for ball 300 is the radially outer portion of projection 311. The Z axis of core 302 extends centrally through a smaller rod-like internal core projection 315 having a planar outer surface 316 that is approximately perpendicular to the axis Z.

Bowling ball 300, FIGS. 8 and 9, further includes a urethane or filled polyester inner shell 320 into which core 302 is molded. The outer shell 321 of bowling ball 300 encompasses inner shell 320. The outer shell 321 may be formed of one of the bowling ball shell compounds sometimes referred to as REACTIVE RESINS. Preferably, however, outer shell 321 is formed of a co-polymer resin blended with poliols, diols, or both. A small amount of pigment is also usually present in shell 321. In some bowling balls, particularly the heavier balls, the inner and outer shells 320 and 321 may be a single, unitary shell, preferably molded co-polymer blended resin, though other resins may be employed.

I claim:

1. A bowling ball comprising:

a core having a predetermined uniform core density $d_c$;

a shell encompassing the core, the shell having a spherical external configuration and a preselected uniform shell density $d_s$;

the core density $d_c$ being larger than the shell density $d_s$; and the core having an asymmetrical shape that has no plane of symmetry.

2. A bowling ball according to claim 1 and further comprising:

a balancing weight, within the shell, having a uniform balancing weight density $d_w$;

the relationship of the densities being $d_w>d_c>d_s$.

3. A bowling ball according to claim 2 in which the balancing weight and the core are formed as an integral, one-piece central core structure in the bowling ball, totally encompassed by the shell.

4. A bowling ball according to claim 2 in which the shell comprises:

an inner layer encompassing the core, the inner layer of the shell having a spherical external configuration and a uniform density $d_{s1}$; and and outer layer encompassing the inner layer, the outer layer having a spherical external configuration and a uniform density $d_{s2}$;

the relationship of the densities being $d_w>d_c>d_{s2}>d_{s1}$.

5. A bowling ball according to claim 4 in which the outer layer of the shell is a co-polymer resin that includes a styrene/acrylonitrile resin.

6. A bowling ball according to claim 5 in which the balancing weight and the core are formed as an integral, one-piece central core structure in the bowling ball, totally encompassed by the shell.

* * * * *